US006170699B1

(12) United States Patent
Kim

(10) Patent No.: US 6,170,699 B1
(45) Date of Patent: Jan. 9, 2001

(54) TABLET SUPPLYING APPARATUS FOR TABLET SORTING AND COUNTING MACHINE

(76) Inventor: Jin Soo Kim, 224-37 Naedang-Dong, Suh-gu, Taegu (KR)

( * ) Notice: Under 35 U.S.C. 154(b), the term of this patent shall be extended for 0 days.

(21) Appl. No.: 09/364,547

(22) Filed: Jul. 29, 1999

(30) Foreign Application Priority Data

Jul. 29, 1998 (KR) ..... 31464

(51) Int. Cl.[7] ..... G07F 11/00
(52) U.S. Cl. ..... 221/85; 221/253
(58) Field of Search ..... 221/69, 75, 82, 221/84, 85, 92, 119, 123, 253, 174

(56) References Cited

U.S. PATENT DOCUMENTS 3,263,857 * 8/1966 Krakauer et al. ..... 221/85

* cited by examiner

*Primary Examiner*—Kenneth W. Noland
(74) *Attorney, Agent, or Firm*—John K. Park; Park & Sutton LLP

(57) ABSTRACT

A tablet supplying apparatus for a tablet dispensing system includes a conveyer belt carried over on a driving roller and a driven roller, a plurality of tablet receiving trays, and a plurality of hoppers. A tablet release means is provided adjacent to a rear portion of said conveyer belt for releasing tablets in a plurality of tablet input ports correspondingly placed above the tablet receiving trays. The hoppers are attached to a guide which is cross-fixed between lower portions of a pair of side plates forming the frame. Each of the hopper includes a release guide, a lever and a control plate unitary therewith. The release guide is raised (opened) by a corresponding one of a plurality of cams regularly carried on a cam shaft driven by a first motor. said tablet release means including a cam lever, said cam lever making an angular movement in accordance with an eccentric cam engagedly connected to a second motor, said cam lever hingedly connected to said frame, an upper portion of said cam lever being hookable into a hooker opening formed in a corresponding portion of a release plate disposed underneath said tablet input ports, whereby said release plate is pulled by said cam lever so that a plurality of release openings formed through said release plate correspond to said tablet input ports thereabove for thereby facilitating the tablet releasing therethrough.

3 Claims, 8 Drawing Sheets

TABLET SUPPLYING APPARATUS FOR TABLET SORTING AND COUNTING MACHINE

BACKGROUND OF THE INVENTION

1. Field of Invention

The present invention relates to a tablet dispensing system, and more particularly to an improved tablet supplying apparatus for a tablet dispensing system which may be either independently installed on a manually operating tablet dispenser or applied to an automatic tablet dispensing system, thereby realizing an additional dispensing operation for such extra tablets as prescription-missing tablets and half-split tablets.

2. Description of the Prior Art

In general, a tablet dispensing system varies from an automated tablet dispenser to a manually operating tablet dispenser. Automated tablet dispensers are employed in hospitals and drugstores to automate the output and assembly of corresponding tablets when a prescription is input into a computer for thereby dispensing the per-dosage assembled tablets.

The structure of an automatic tablet dispensing system includes: a main computer for enabling an appropriate prescription on the basis of proper medicine, intake method, daily intake frequency and intake duration depending upon each patient; a tablet dropping unit having a plurality of tablet cassettes and a drum for storing therein and releasing therefrom the tablets in correspondence to the prescription set up in the computer; and a packaging unit disposed below the tablet dropping unit to package the output tablets and release the same to an exterior of the automatic tablet dispenser.

The packaging unit is made up of: a release hopper for assembling the tablets being dropped from the tablet drop unit; a heater assembly for packaging the tablets being discharged through the release hopper; a printer for printing respective information on packaging paper; and a release conveyer for externally discharging the medicine bags containing tablets.

As for a manually operating dispenser, it's structure includes tablet mounting trays provided on top of the machine body. Provided below the tablet mounting trays are as many tablet transfer trays fixed to the surface of a conveyer as the tablet mounting trays. The conveyer makes a reciprocal movement using a motor.

A packaging unit similar to or identical to that of the automatic tablet dispenser is located below the tablet transfer trays to package and release the dropped tablets.

In the case of the conventional automatic tablet dispenser, a disadvantage is that the storing cassettes cannot accommodate irregularly shaped tablets and split portions of tablets.

As for the manually operation tablet dispenser according to the conventional art a disadvantage is that the need for the rectangular type tablet transfer trays to reciprocate from side to side so as to drop the tablets contained therein, necessitates a larger machine body and accordingly a more spacious location for installation. That is, since the tablet transfer tray set in plate shape (when relatively viewed in comparison to width and length) reciprocates from left to right side, the entire size of the machine body is determined by the size of the tablet transfer tray set.

Accordingly, the machine body should be manufactured larger to process a larger quantity of tablets at one time and a smaller machine body decreases the processing speed and capacity of tablet packaging, thereby incurring problems in machine design and production.

SUMMARY OF THE INVENTION

The present invention is contrived to overcome the conventional disadvantages. Therefore, it is an object of the present invention to provide a tablet supplying apparatus for a tablet dispensing system which is applicable either to an automatic tablet dispenser or to a manually operating tablet dispenser which improves the efficiency and workability of the tablet dispensing system.

To achieve the above-described object, there is provided a tablet supplying apparatus for an automatic tablet sorting and counting machine according to the present invention, which includes a conveyer belt carried over on a driving roller and a driven roller located between a pair of side plates forming a frame. The tablet supplying apparatus further includes a plurality of tablet receiving trays with each tablet receiving tray having a plurality of tablet holding openings unitary therewith and regularly fixed to corresponding outer surface portions. A plurality of hoppers are positioned adjacent to the driving roller for temporarily storing therein tablets released from frontmost trays of the tablet receiving trays. A tablet input receptable having a plurality of tablet input ports and a release plate attached therebeneath is removeably attached above the tablet supplying apparatus. A tablet release means is provided adjacent to a rear portion of the conveyer belt for releasing any tablets placed in the tablet input ports correspondingly located above the tablet receiving trays. Each of the hoppers are attached to a guide cross-fixed between lower portions of the side plates forming the frame. The hoppers are partitioned by a plurality of interwalls in regular intervals between the side plates forming the frame, with each hopper further including a release guide, a lever, and a control plate unitary therewith. The release guide is raised (opened) by a corresponding one of a plurality of cams regularly carried on a cam shaft driven by a first motor. The tablet release means includes a cam lever with the cam lever making an angular movement in accordance with an eccentric cam engagedly connected to a second motor. The cam lever is hingedly connected to the frame, and an upper portion of the cam lever is hookable into a hooker opening formed in a corresponding portion of the release plate placed below the tablet input ports, whereby the release plate is pulled by the cam lever so that a plurality of release openings formed through the release plate correspond to the tablet input ports thereabove for thereby facilitating the release of tablets therethrough.

DETAILED DESCRIPTION OF THE PREFERRED EMBODIMENTS

With reference to the accompanying drawings, the present invention will now be described.

Figure 1:
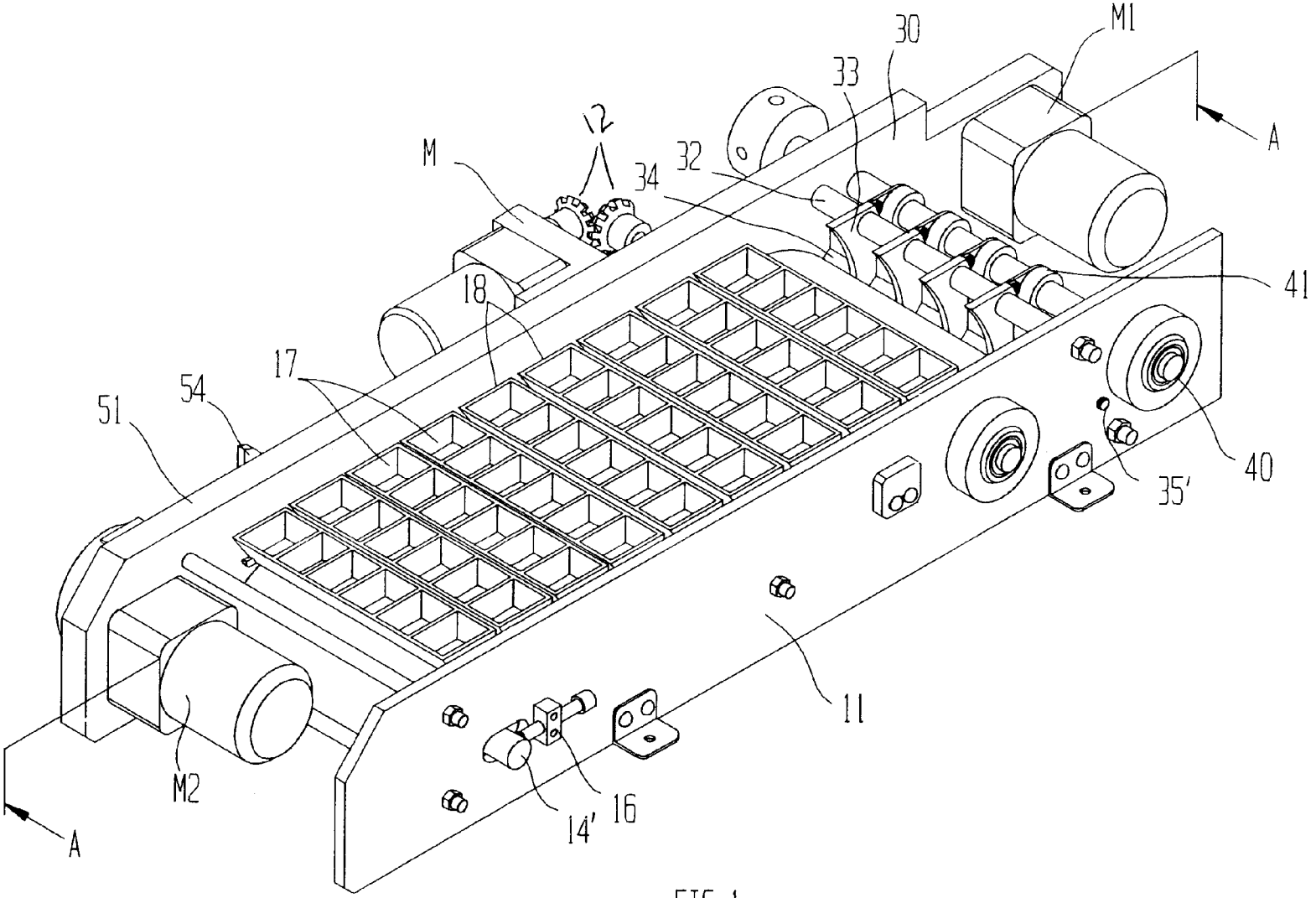
FIG. 1 is a perspective view illustrating a tablet supplying apparatus for a tablet dispensing system according to the present invention with the tablet input receptacle removed to show the tablet receiving trays.
Figure 2:
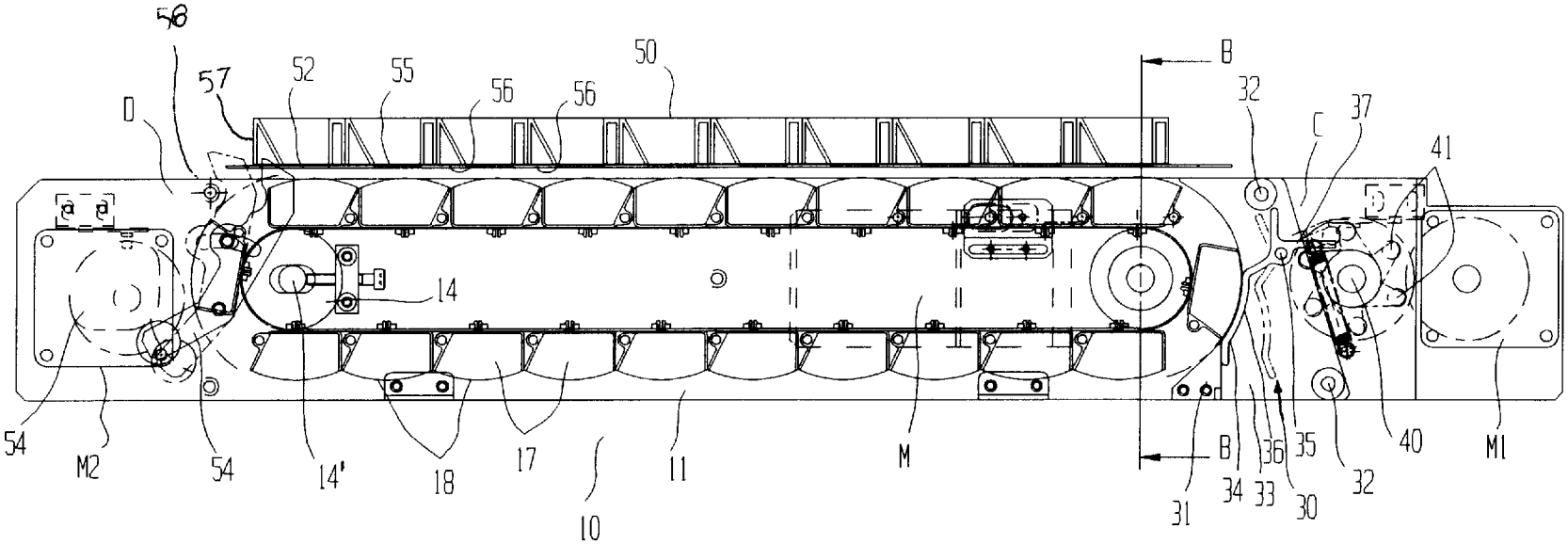
FIG. 2 is a cross-sectional side view taken along line A—A in FIG. 1.
Figure 3:
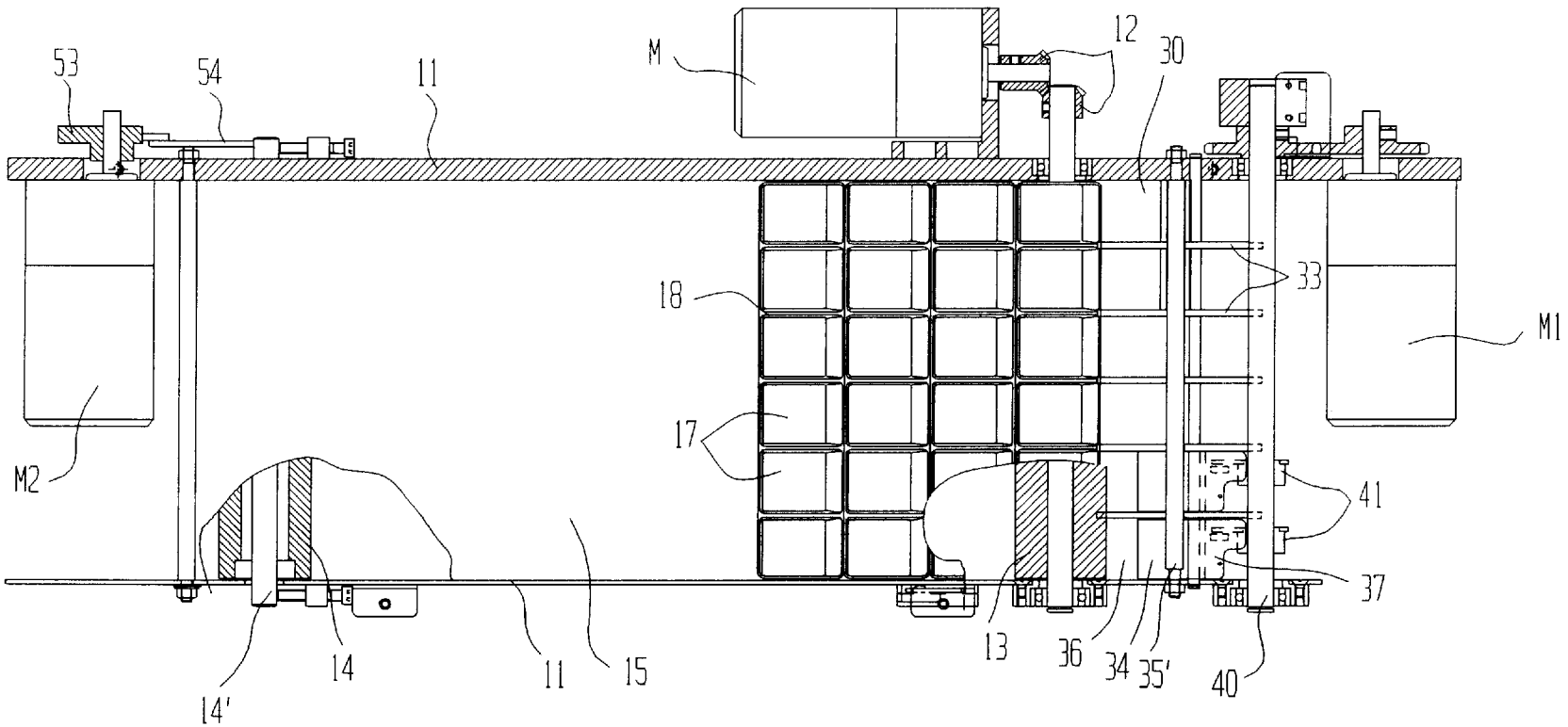
FIG. 3 is a partially cutout top plan view illustrating the tablet supplying apparatus for a tablet dispensing system according to the present invention with the tablet input receptacle removed.

As shown in FIGS. 1 through 3, the tablet supplying apparatus for an automatic tablet dispensing system according to the present invention includes a frame 11 wherein a pair of parallel plates are fixed by connection rods to each other thereof, bevel gears 12, a driving roller 13, a driven roller 14, and a conveyer belt 15. The driving roller 13 engages the bevel gears 12 which are driven by roller motor M . Here, the rollers 13, 14 are spaced from each other and cooperably rotate via the conveyer belt 15. It should be understood that a tension control member 16 adopting a known screw control method is applied to a shaft 14' of the driven roller 14 so as to maintain an appropriate tension on the conveyer belt 15.

A plurality of rod type are crossingly and fittingly arranged on and along the conveyer belt 15. The tablet receiving trays 18 are respectively provided with each having a tablet holding opening 17.

Figure 4:
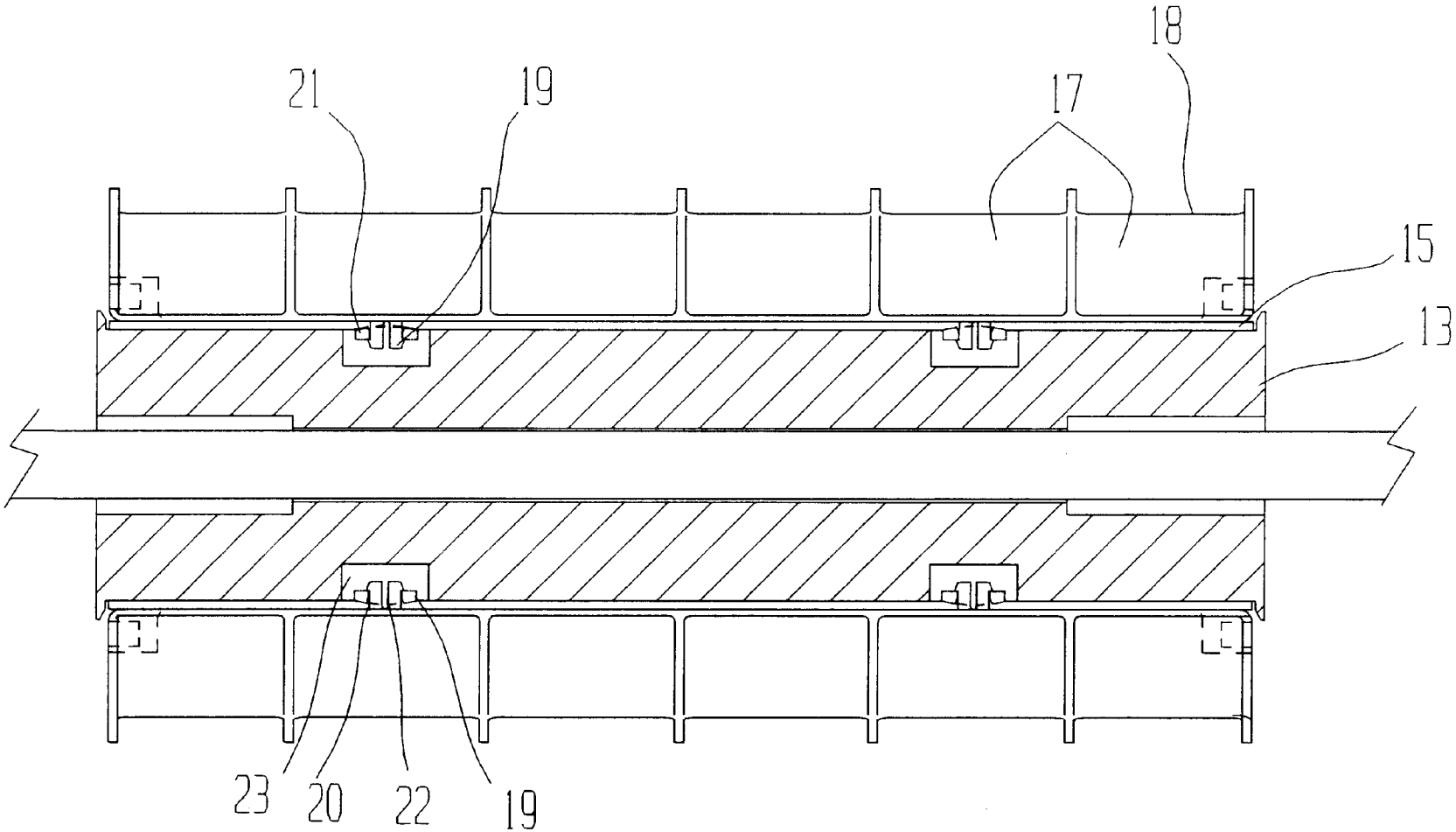
FIG. 4 is a cross-sectional view of the present invention taken along line B—B in FIG. 2, shown here with the tablet input receptacle removed.

As shown in FIG. 4, the tablet receiving tray 18 has a fixing pin 19 extending from therebeneath. The fixing pin 19 becomes forcedly engaged into a corresponding fixing opening 20 formed through the conveyer belt 15 and the engaged fixing pin 19 is tightened by a protection ring 21 carried thereon. Also, an elastic slot 22 is formed in the fixing pin 19 for smooth engagement. A plurality of recesses 23 are formed in corresponding surface portions of the rollers 13, 14 so as to prevent intervention from occurring between the fixing pin 19 and the rollers 13, 14.

A plurality of hoppers 30 are provided adjacent to the driving roller 13 to temporarily hold and release the tablets being thrown over from the tablet holding openings 17 of the turning-down tablet receiving tray 18.

Figure 5:
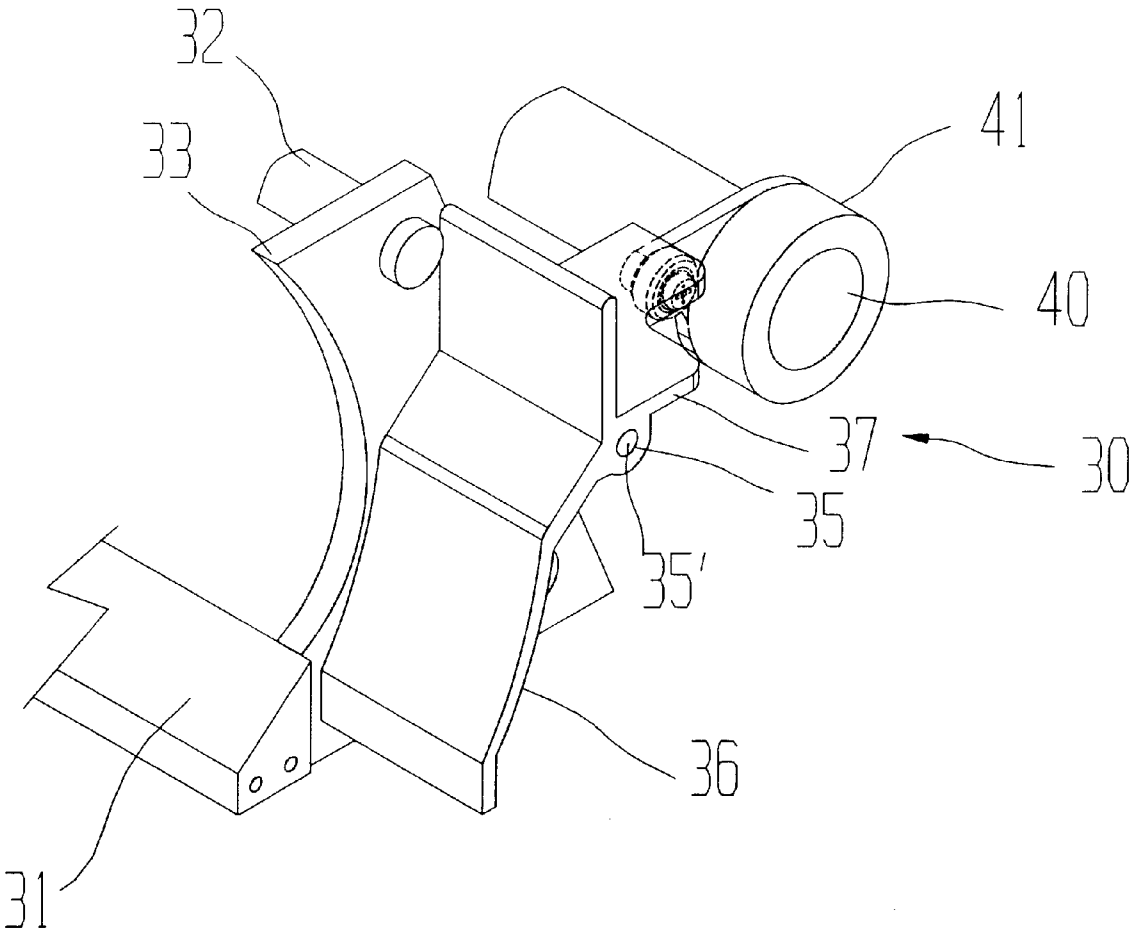
FIG. 5 is a schematic perspective view detailing portion C in FIG. 2.

Referring to FIG. 5, each hopper 30 attaches to a guide 31 and includes a cross fixing bar 32, a release guide 34, a connection hole 35, a connection bar 35', a J-shaped lever 36, and a control plate 37. Each hopper 30 is separated from one another by an interwall 33. The guide 31 is fixedly located between the side plates forming the frame 11 by use of screw members. The interwalls 33 are supported by the fixing bar 32 which appropriately penetrates therethrough and are fixed with regular intervals between the side plates of the frame 11. The release guide 34, the connection hole 35, the lever 36 and the control plate 37 are formed unitarily with each other between the interwalls 33. The connection bar 35' is hingedly inserted through the connection hole 35 and corresponding portions of the interwalls 33

The release guide 34 extends downwardly from below the connection hole 35, and the J-shaped lever 36 is curved toward the guide 31 until it abuts a side portion of the guide 31 which is fixed to the frame 11. The control plate 37 extends from in front thereof, so that the roller motor M provided between the front end portions of the frame 11 serves to raise (open) the release guide 34. That is, the control plate 37 is raised by a corresponding cam 41 carried on a motor shaft 40, and the release guide 34 is raised (opened) in accordance therewith. Here, a plurality of cams 41 are carried on the motor shaft 40 at regular intervals. Also, it is a known art to apply a restoring member such as a spring (not shown) in the connection hole 35 so as to produce elasticity with the connection bar 35'.

The cams 41 control the release guide 34, and the number of the cams 41 corresponds to the number of the tablet holding openings 17 in a row of tablet receiving trays 18 whereby as much phase variation as the tablet holding openings 17 allows the release guides 34 to be sequentially raised (opened).

As shown in FIG. 2, the apparatus further includes a tablet input receptacle 57 having a plurality of tablet input ports 50 placed over the tablet supplying apparatus. Each of the tablet input port 50 has an open top and an open bottom, and each tablet input port is disposed above a corresponding tablet receiving tray 18. A release plate is slideably attached beneath the tablet input receptacle. The release plate 52 slides from a closed position to a open position. In a closed position, the release plate 52 prevents tablets placed in the tablet input port 50 from falling into the tablet receiving tray 18 below. A plurality of release openings 56 corresponding to the number and location of the tablet input ports 50 is formed through the release plate 52. In the open position, each of the release opening 56 aligns beneath a corresponding tablet input port 50 to allow the passage therethrough of any stored tablet.

Figure 6:
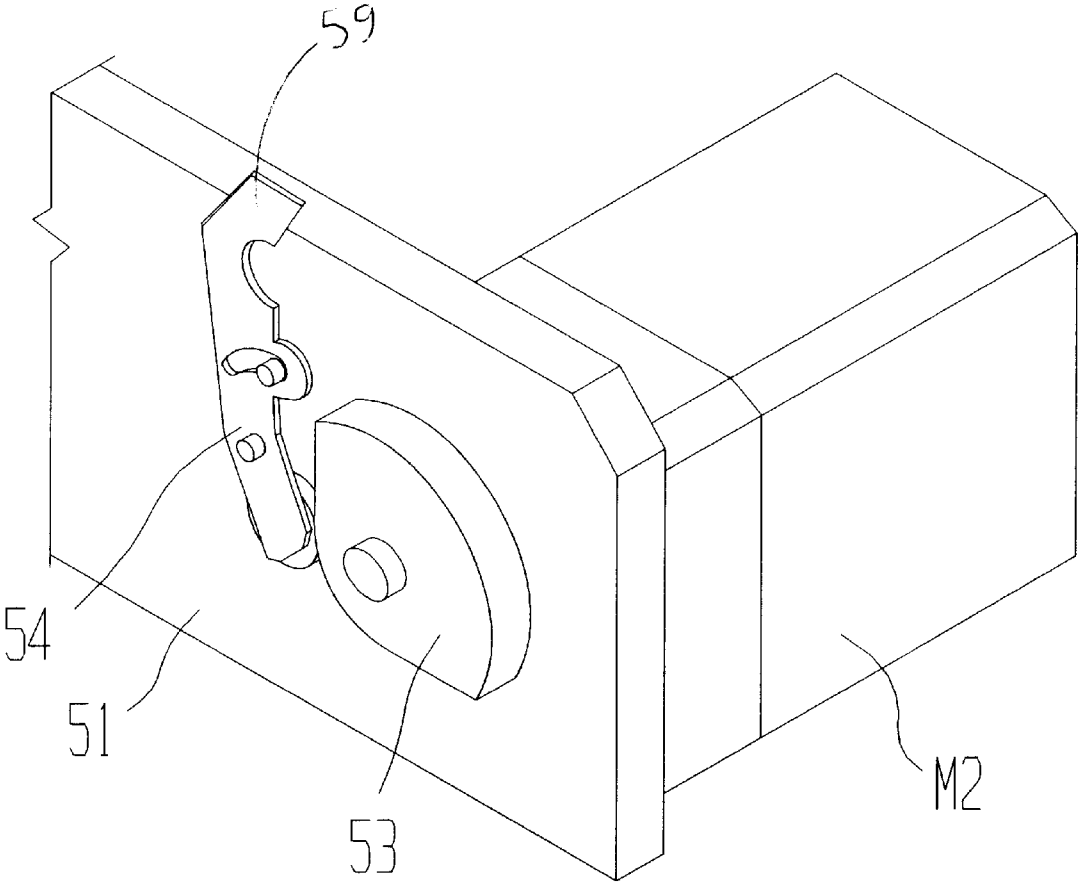
FIG. 6 is a schematic perspective view detailing portion D in FIG. 2.

As further shown in FIG. 1 and FIG. 6, a tablet release member 51 is placed in the rear portion 58 of the conveyer belt 15 to facilitate the release of tablets into the tablet input ports 50. The tablet release member 51 as shown in FIG. 6 includes an eccentric cam 53 and a cam lever 54 which connects to the release plate 52. The eccentric cam 53 is carried on the shaft of a second motor M2. The rotation of the eccentric cam 53 controls operates the cam lever 54 to interchangeably slide the release plate 52 between the open and the closed position. The cam lever 54 is hingedly fixed to the frame 11 and makes an angular movement as caused by the eccentric cam 53. An upper portion 59 of the cam lever 54 is formed such that it is hooked into a hooker opening 55 formed on the release plate 52.

The operation of the above described tablet supplying apparatus 10 for a tablet dispensing system according to the present invention will now be explained.

Figure 7:
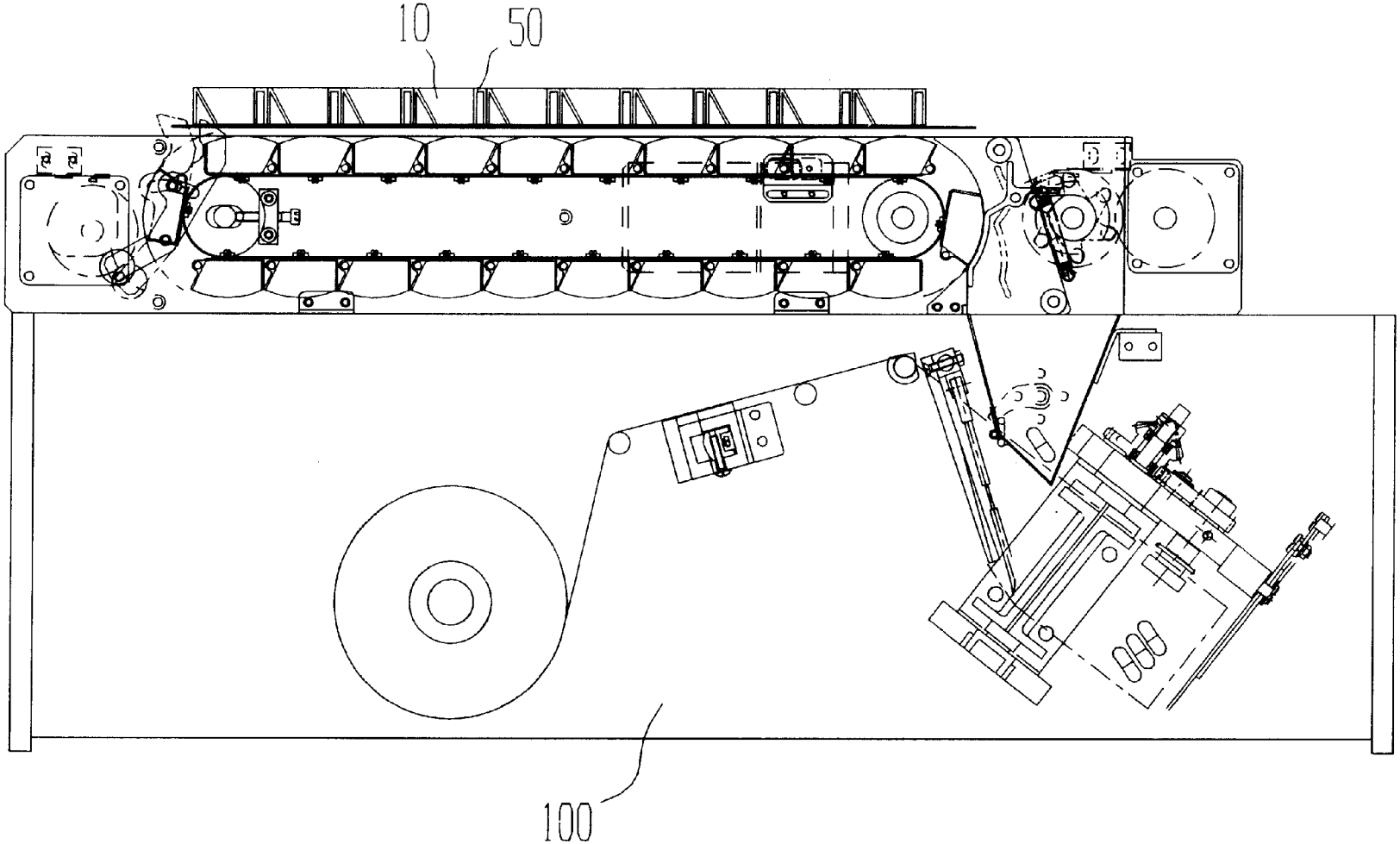
FIG. 7 is an application view illustrating the tablet supplying apparatus for a tablet dispensing system according to an embodiment of the present invention.
Figure 8:
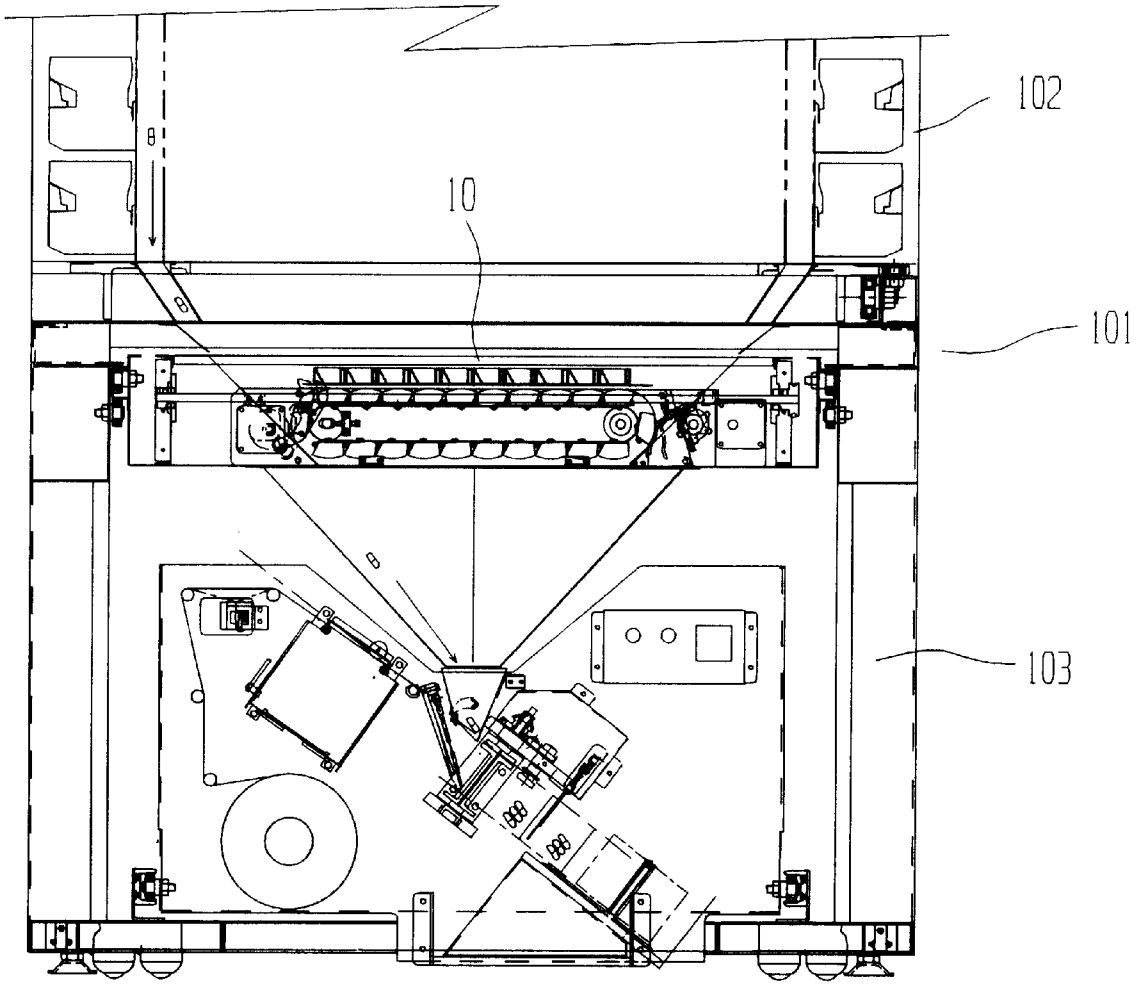
FIG. 8 is an application view illustrating the tablet supplying apparatus for a tablet dispensing system according to another embodiment of the present invention.

As shown in FIGS. 7 and 8 illustrating the preferred embodiments of the present invention, the tablet supplying apparatus 10 may be disposed either on top of a manually operating tablet dispenser 100 or between a tablet dropping unit 102 and a packaging unit 103 of an automatic tablet dispenser 101 for thereby being used either independently or in automated linkage.

Using the tablet supplying apparatus 10, such extra tablets as half split tablets, one-third split tablets and rarely prescribed tablets, as well as regular type tablets, are smoothly processed in tablet dispensing and packaging steps.

In further detail, an operator spreads required tablets into each tablet input port 50 installed above the tablet supplying apparatus 10. At this time, the tablets spread in the ports 50 remain in a state in which the tablet dropping is prevented due to the release plate 52 abuttingly disposed beneath tablet input ports 50. After spreading the tablets into the ports 50, the tablet supplying apparatus 10 is set back in position, and the second motor M2 of the tablet release member 51 rotates the eccentric cam 53. Accordingly, the cam lever 54 centered by a hinge to the frame 11 and engaged to the eccentric cam 53 makes an angular movement.

When an upper portion of the cam lever 54 is hooked into the hooker opening 55 correspondingly formed in the release plate 52 in accordance with the angular movement thereof, the release plate 52 becomes rearwardly (to the left in FIGS. 1 and 2) pulled to the open position where the plurality of release openings 56 formed through the release plate 52 correspond to the tablet input ports 50. Any respective tablets momentarily placed in the tablet input ports 50 are passed via the release openings 56 into the respective tablet receiving trays 18. Then, the roller motor M drives the conveyer belt 15 by one pitch (from one tablet receiving tray to another) and thusly the tablet receiving ports 18 fixed to the conveyer belt 15 are moved so that the tablets in the frontmost port of the tablet receiving ports 18 are dropped into the hopper 30 provided in front thereof.

When the tablets in the frontmost tablet receiving tray 18 are dropped into the hopper 30, the conveyer belt 15 momentarily stops operating while the first motor M1 is operated to open the hopper 30, and the cams 41 carried on the cam shaft 40 begin their rotation.

The cams 41 are rotated by the first motor M1 at the speed identical to the packaging speed in the packaging unit 103 therebelow so that the respective hoppers 30 are sequentially opened. The number of hoppers 30 corresponds to the number of tablet receiving ports 18 in a single row of ports 18. The hoppers 30 are aligned and partitioned by interwalls 33. The cams 41 carried on the cam shaft 40 have as many phase variations as the number of the hoppers 30 in accordance with the rotation of the first motor M1 which results in the release guides 34 of the hoppers 30 being sequentially raised (opened) without their simultaneous opening operation.

The cams 41 driven by the rotation of the cam shaft 40 upwardly push the control plate 37 extending toward the cam shaft 40 so that the lever 36 which extends downwardly from the release guide 34 is detached from the guide 31. When this occurs, the tablets in the hopper 30 are released into the packaging unit 103 therebelow.

In accordance with such serial operations as described above, the tablets are spread and sequentially released into the packaging unit therebelow for packaging operation.

Here, it should be understood that the respective operations of the conveyer belt 15 for horizontal tablet transfer, the cams 41 for opening the hoppers 30 gathering the tablets from the tablet holding openings 17 and the cam lever 54 for dropping the tablets into each opening 17 of the respective tablet receiving trays 18 are realized by use of a variety of sensors or timing controllers.

As discussed above, the tablet supplying apparatus for a tablet dispensing system is incorporated in an endless orbit cycle so that the tablets in the respective openings of the frontmost tablet receiving tray 18 are simultaneously released into the corresponding hoppers 30 and the released tablets are sequentially dropped into the packaging unit 103 therebelow. Further, the present invention is applicable to a manually operation tablet dispenser as well as an automatic tablet dispenser, thereby improving efficiency and workability in tablet dispensing operation.

What is claimed is:

1. A tablet supplying apparatus for a tablet dispensing system, comprising:

a motor-operated conveyer belt carried on a driving roller and a driven roller, said conveyor belt and said rollers being disposed between a pair of side plates forming a frame;

a plurality of tablet receiving trays arranged in rows and disposed on the surface of said conveyor belt, each of said tablet receiving tray having a tablet holding opening unitary therewith;

means to connect each of said tablet receiving tray to said conveyor belt;

a guide cross-fixed between lower portions of said side plates forming said frame;

a row of hoppers disposed on said guide adjacent to said driving roller, said hoppers temporarily storing therein tablets released from said trays, said hoppers being partitioned by a plurality of interwalls;

a tablet input receptacle having a plurality of tablet input ports disposed over said tablet supplying apparatus; whereby, each of said tablet input port having an open top and an open bottom is disposed above a corresponding tablet receiving tray;

a release plate disposed beneath said tablet input receptacle underneath said tablet input ports; said release plate having a plurality of release openings formed through said release plate corresponding to said tablet input ports thereabove;

a tablet release means provided adjacent to a rear portion of said conveyer belt for releasing tablets placed in said tablet input ports;

each of said hopper including a release guide, a lever and a control plate unitary therewith;

a cam shaft disposed between said side plates of said frame;

a first motor disposed on said frame adjacent said cam shaft for rotating said cam shaft;

said release guide being raised (opened) by a corresponding one of a plurality of cams regularly carried on said cam shaft; and, said tablet release means including a cam lever, said cam lever making an angular movement in accordance with an eccentric cam engagedly connected to a second motor, said cam lever hingedly connected to said frame at one end and having a second end which is hookable into a hooker opening formed in a corresponding portion of said release plate; whereby, the rotation of said eccentric cam causes said cam lever to pull said release plate aligning said openings of said release plate with said corresponding tablet input ports above thereby facilitating the release of tablets into the corresponding tablet receiving trays therebelow.

2. The apparatus as described in claim 1 wherein said means to connect each of said tablet receiving tray to said conveyor belt comprises:

a fixing pin attached beneath each of said tablet receiving tray;

a corresponding fixing opening is formed through said conveyor belt, said fixing pin being engaged to said corresponding fixing opening;

an elastic slot formed in said fixing pin for smooth engagement with said fixing opening; and, a plurality of recesses formed on corresponding outer periphery surface portions of said driving and driven rollers for preventing intervention from occurring between said fixing pin and said rollers.

3. The apparatus as described in claim 1, wherein said cams carried on said cam shaft have phase variations different from each other for sequentially raising (opening) said release guides.

* * * * *